US006032360A

United States Patent [19]

Bornhorst et al.

[11] Patent Number: 6,032,360

[45] Date of Patent: Mar. 7, 2000

[54] TOOL AND METHOD TO ADJUST ECCENTRIC TIMING ON ADJUSTABLE STROKE CRANKSHAFT

[75] Inventors: John B. Bornhorst, New Bremen; Richard J. Oen, Wapakoneta, both of Ohio

[73] Assignee: The Minster Machine Company, Minster, Ohio

[21] Appl. No.: 08/797,518

[22] Filed: Feb. 7, 1997

[51] Int. Cl.[7] ..... B21K 1/08

[52] U.S. Cl. ..... 29/888.01; 29/6.01; 29/888.011

[58] Field of Search ..... 29/6.01, 888.01, 29/888.011, 888.1; 72/61, 62; 123/48 B, 78 F

[56] References Cited

U.S. PATENT DOCUMENTS 4,450,612 5/1984 Kelly ..... 72/62
4,785,732 11/1988 Czapka et al. ..... 100/257
5,052,845 10/1991 Maus et al. ..... 29/888.1
5,307,709 5/1994 Bareis et al. .
5,357,774 10/1994 Klages et al. ..... 72/62

FOREIGN PATENT DOCUMENTS 2 166 844 5/1986 United Kingdom ..... F16D 1/08

*Primary Examiner*—David P. Bryant
*Assistant Examiner*—Jermie E. Cozart
*Attorney, Agent, or Firm*—Randall J. Knuth

[57] ABSTRACT

The invention includes a tool for adjusting the timing of eccentrics on a crankshaft connected by an infinitely variable, pressure actuated connection. In cases where there is more than a single adjustable eccentric on the crankshaft, it is preferable that all of the eccentrics display the same timing characteristics relative to the crankshaft. If one eccentric has a location or timing different than that of the other eccentrics, the tool and method is used to adjust such eccentric to place it back into its preferred location and timing relative the crankshaft and other eccentrics.

8 Claims, 1 Drawing Sheet

TOOL AND METHOD TO ADJUST ECCENTRIC TIMING ON ADJUSTABLE STROKE CRANKSHAFT

BACKGROUND OF THE INVENTION

1. Field of the Invention

The present invention relates to adjustable stroke crankshafts and, more particularly, to a tool and method for adjusting the eccentric timing used with adjustable stroke connections within a press.

2. Description of the Related Art

In mechanical presses, is often desirable to adjust or change the stroke length in a reciprocating member, for example the slide, to which the tooling is installed. In some prior art tooth adjustment systems, there is a tendency for the system parts to wear after a certain period of operation time.

An adjustable stroke connection and crankshaft as shown in U.S. patent application Ser. No. 08/738,843, the invention of which is assigned to the assignee of the present invention, the disclosure of which is hereby incorporated by reference, shows a system which provides a quick, easy, and accurate way to adjust the stroke length of the slide or other parts by changing the timing of the eccentrics on the crankshaft.

Although at the time of manufacture, steps during assembly are taken to assure that the eccentric timing of each eccentric on the crankshaft has the same period, there is a possibility that during assembly, or after use, that one or more eccentric may lose or change its timing relative to any of the other eccentrics on the crankshafts. The present invention provides a tool and method to adjust the eccentric timing and location of the eccentric about the crankshaft.

SUMMARY OF THE INVENTION

The present invention provides a tool for adjusting the timing of eccentrics on a crankshaft, particularly those types of eccentrics connected by a infinitely variable, pressure actuated connection. In cases where there is more than a single adjustable eccentric on the crankshaft, it is preferable that all eccentrics display the same timing characteristics relative to the crankshaft. If an eccentric location or timing is different that the other eccentrics, the present tool and method may be used to adjust such eccentric to place it back into its preferred location timing relative to the crankshaft and other eccentrics.

The tool includes a rod insertable into an axial bore in the crankshaft to seal a first portion of the axial bore. A pressurizing means is used for pressurizing a second portion of the axial bore to permit adjustment of one of the eccentrics on the crankshaft. This adjustment takes place without disturbing the relative timing or location of the other eccentrics on the crankshafts.

The invention comprises, in one form thereof, an insertable member, such as a rod, insertable into an axial bore of a crankshaft to seal the first portion of the axial bore and a pressurizing means for pressurizing a second portion of the axial bore to permit adjustment of one of the eccentrics on the crankshaft. In one embodiment, the member may be a rod having an O-ring seal thereon.

The invention comprises, in another form thereof, a method of adjusting the location of an eccentric attached to a crankshaft by a pressure operated connection, the crankshaft having an axial bore therethrough in communication of the pressure operated connection. One type of pressure operated connection may be that of a pressfit connector released by high pressure fluid. The adjustment method comprises the steps of providing a rod member sized for insertion into the axial bore to seal a portion of the axial bore, inserting the rod member into the axial bore, pressuring a second portion of the axial bore communication with the pressure operated connection thereby releasing the connection, then rotating one of the crankshaft and eccentric to adjust to the relative location therebetween and then depressurizing the second portion of the axial bore, thereby the pressure operated connection reconnects the crankshaft to the eccentric.

An advantage of the present invention, is that a simple stroke adjustment connection, operated by fluid pressure, may be independently controlled to change the relative timing and placement of an eccentric on the crankshaft.

Another advantage of the present invention is that of quicker assembly and setup of the press eccentric crankshaft combination system. Additionally, maintenance costs for adjustment and replacement parts are reduced.

Yet another advantage of the present invention, is that it is adapted to alter the timing and location of a single eccentric on a crankshaft having multiple eccentrics without disassembly of the machine.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
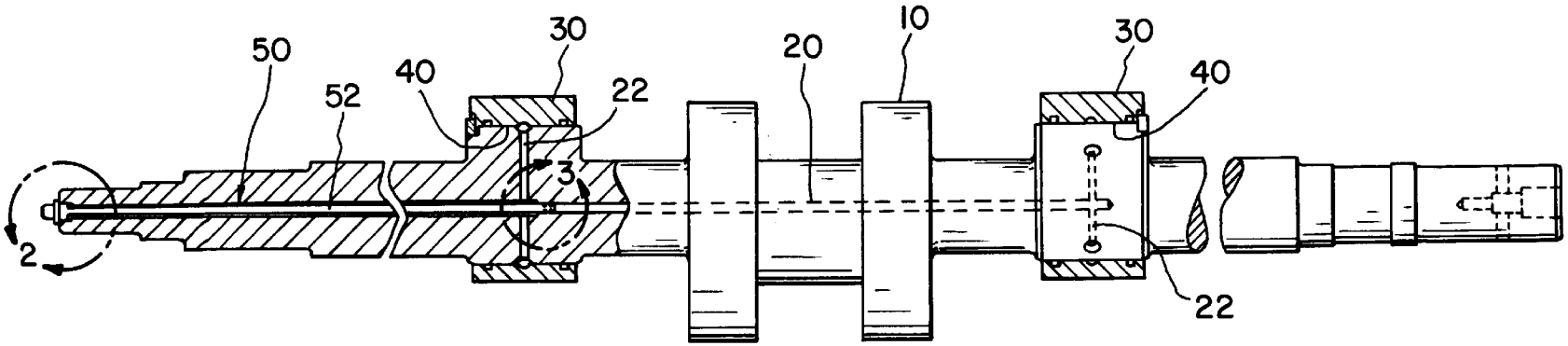
FIG. 1 is a fragmentary sectional view of an adjustable stroke crankshaft having eccentrics thereon. The crankshaft is shown having a tool of the present invention disposed therein.

The tool for adjusting the timing of eccentrics having an adjustable stroke connection is shown in FIG. 1. A crankshaft 10 includes an axial bore 20. Axial bore 20 is connected to radial bores 22 that run through crankshaft 10 and are in communication with adjustable eccentrics 30. As disclosed in U.S. patent application Ser. No. 08/738,843, which disclosure is hereby incorporated by reference, pressurized fluid may be conducted through axial bore 20 through radial bores 22 and into contact with eccentrics 30. This pressurized fluid separates the interference fit 40 between eccentrics 30 and crankshaft 10 thereby allowing relative rotation therebetween. This relative rotation changes the timing of eccentrics 30 upon crankshaft 10.

At times during assembly or operation, it may be necessary to adjust the eccentric timing of a single eccentric 30 relative to another on crankshaft 10. Such adjustment necessitates that only one interference fit 40 be broken to permit a change of timing and location of that associated eccentric 30.

Figure 3:
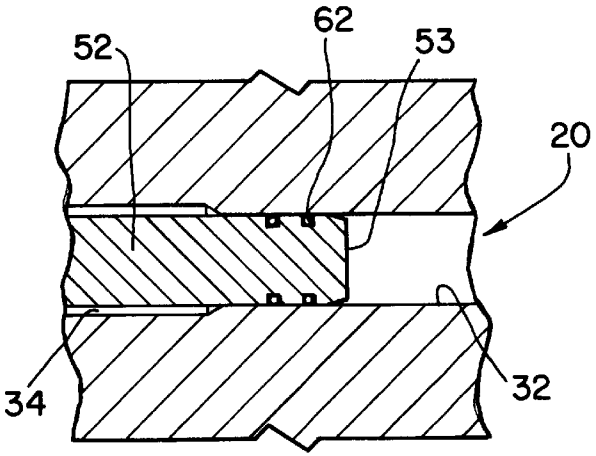
FIG. 3 is a enlarged fragmentary view of the distal end of the tool, including an O-ring seal thereon.

Tool 50 of the present invention includes a rod member 52 that is insertable within axial bore 20. Rod member 52 includes an distal end 53 and a proximal end 55. Axial bore 20 is thereby divided by distal end 53 into a first portion 32 and second portion 34. A single radial bore 22 is in communication with second portion 34. In FIG. 3, rod member 52 is located within and seals second portion 34 of bore 20 from first portion 32.

Figure 2:
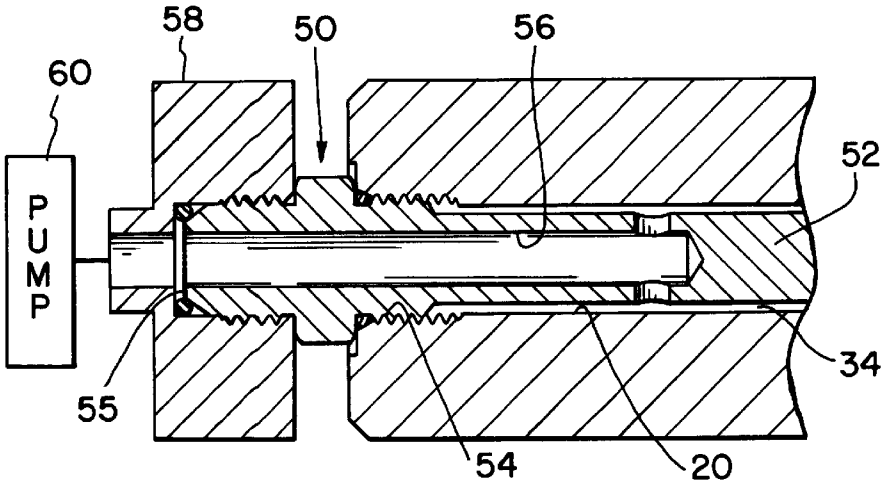
FIG. 2 is a fragmentary sectional view of the tool of the present invention showing a sealing connection between the tool and crankshaft.

As shown in FIG. 2, rod 52, when inserted into axial bore 20, seals near its proximal end 55 by a threaded fitting 54, although others sealing mechanisms may be utilized. Rod 52 includes its own fluid passageway 56 that permits pressurized fluid to pass from an area outside of crankshaft 10 into the interior of axial bore 20, this area referenced as the second portion 34 of axial bore 20. Proximal end 55 of rod 52 is connected a rotary union 58 to permit a rotatable pressurized connection to passageway 56 when crankshaft 10 is rotated for timing adjustment. A pressurizing means for pressurizing a portion of axial bore 20 is shown diagrammatically as a pump 60. Pump 60 provides a source of high pressure fluid, such as oil, at approximately 4,000 to 10,000 PSI pressurization to enable operation and release of the adjustable eccentric connection (interference fit 40) of one connecting eccentric 30 to crankshaft 10. Distal end 53 of rod 52 seals within axial bore 20 thereby sealing first portion 32 from second portion 34. Rod 52 may include a seal mechanism, such as an O-ring 62, to prevent pressurization of first portion 32 during operation. Additional sealing function between first portion 32 and second portion 34 may be constructed by tapering either rod 52 or a section of bore 20, or both.

In operation, the present invention is used to vary the location and timing of eccentric 30 relative to any other timing of other eccentrics 30 on the same crankshaft. The method of adjusting the location of eccentric is that first rod 52 is inserted into axial bore 20, such that distal end 53 interfits with bore 20, thereby sealing first portion 32 from second portion 34. Rotary union 58 is connected to shaft 20 to thereby permit pressurized fluid from pump 60 to pressurize second portion 34. After pump 60 is operated, thereby pressurizing second portion 34 also pressurizes connected radial bore 22 to the eccentric 30 in which the timing is wished to be changed. Such pressurization releases the pressure operated connection interference fit 40 between eccentric 30 and crankshaft 10. Crankshaft 10 is then rotated to the proper location to accurately locate eccentric 30 thereabout.

After the relative location of eccentric 30 about crankshaft 10 is reached, pump 60 is shut off, thereby depressurizing the second portion 34 of axial bore 20, whereby the pressure operated connection interference fit 40 reconnects the eccentric 30 to crankshaft 10.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A tool for in combination with a crankshaft for adjusting the timing of eccentrics connected by a pressure operated connection to a crankshaft, said combination comprising:

a crankshaft having an axial bore therethrough, a plurality of axially spaced eccentrics mounted thereon, and a plurality of transverse channels in fluid communication with said axial bore, each transverse channel being axially aligned with a respective eccentric;

a rod insertable into the axial bore to seal a first portion of the axial bore; and a pressurizing means for pressurizing a second portion of the axial bore, said pressurizing means being operable to elastically expand one of the eccentrics on the crankshaft without expanding the crankshaft, to permit adjustment of the eccentrics on the crankshaft.

2. The combination of claim 1 in which said rod has a seal member.

3. The combination of claim 2 in which said seal member seals the axial bore between said first and said second portions.

4. The combination of claim 2 in which said seal member is an O-ring.

5. The combination of claim 1 in which said pressurizing means includes a rotary union attached to said rod for communicating pressurized fluid thereto.

6. The combination of claim 1 in which said pressurizing means includes a high pressure fluid pump.

7. A method of adjusting the location of an eccentric attached to a crankshaft by a pressure operated connection, said crankshaft having an axial bore therethrough in communication with the pressure operated connection, the adjustment method comprising the steps of:

providing a rod member sized for insertion into the axial bore to seal a portion of the axial bore;

inserting the rod member into the axial bore;

pressurizing a second portion of the axial bore in communication with the pressure operated connection, wherein the second portion contains a single eccentric, thereby releasing the connection of the single eccentric from the crankshaft;

rotating one of the crankshaft and eccentric to adjust the relative location therebetween; and de-pressurizing the second portion of the axial bore thereby the pressure operated connection reconnects the eccentric to the crankshaft.

8. A method of adjusting the location of an eccentric attached to a crankshaft by a pressure operated connection, said crankshaft having an axial bore therethrough in communication with the pressure operated connection, the adjustment method comprising the steps of:

providing a member sized for insertion into the axial bore to seal a portion of the axial bore;

inserting the member into the axial bore;

pressurizing a second portion of the axial bore in communication with the pressure operated connection, wherein the second portion contains a single eccentric, thereby releasing the connection of the single eccentric from the crankshaft;

rotating one of the crankshaft and eccentric to adjust the relative location therebetween; and de-pressurizing the second portion of the axial bore thereby the pressure operated connection reconnects the eccentric to the crankshaft.

* * * * *